US006293183B1

(12) United States Patent
Noda

(10) Patent No.: US 6,293,183 B1
(45) Date of Patent: Sep. 25, 2001

(54) COUPLING CONSTRUCTION BETWEEN AN ACTUATOR AND A BASE

(75) Inventor: Mitsuo Noda, Ichinomiya (JP)

(73) Assignee: Howa Machinery, Ltd., Nagoya (JP)

( * ) Notice: Subject to any disclaimer, the term of this patent is extended or adjusted under 35 U.S.C. 154(b) by 0 days.

(21) Appl. No.: 09/510,158

(22) Filed: Feb. 22, 2000

(30) Foreign Application Priority Data

Feb. 23, 1999 (JP) ..... 11-044462

(51) Int. Cl.[7] ..... F15B 15/00
(52) U.S. Cl. ..... 92/88; 92/161
(58) Field of Search ..... 92/88, 161

(56) References Cited

U.S. PATENT DOCUMENTS

| | | | | |
|---|---|---|---|---|
| 5,245,910 | * | 9/1993 | Drittel | 92/88 |
| 5,884,549 | * | 3/1999 | Hosono et al. | 92/88 X |
| 5,974,947 | * | 11/1999 | Noda | 92/88 |
| 5,992,295 | * | 11/1999 | Noda et al. | 92/88 |
| 6,186,049 | * | 2/2001 | Stoll et al. | 92/88 |

FOREIGN PATENT DOCUMENTS

| | | |
|---|---|---|
| 59-227351 | 12/1984 | (JP) . |
| 798741 | 10/1990 | (JP) . |
| 2502856 | 5/1996 | (JP) . |
| 8-210311 | 8/1996 | (JP) . |
| 9-177717 | 7/1997 | (JP) . |
| 10-299714 | 11/1998 | (JP) . |

* cited by examiner

*Primary Examiner*—John E. Ryznic
(74) *Attorney, Agent, or Firm*—Finnegan, Henderson, Farabow, Garrett & Dunner, L.L.P.

(57) ABSTRACT

A rodless cylinder is coupled to an elongated base. The construction for coupling the rodless cylinder to the base includes a hollow duct formed in the bottom wall of the base and extending along the entire length of the base. A projection extending along the entire length of the duct is formed on the upper inner wall of the duct when the base and duct are formed by a drawing or extrusion process. After the base is formed, the longitudinal ends of the projection are cut off by a predetermined length from both longitudinal ends of the base. The portions of the duct from which the projections are cut off act as receiving portions into which mounting nuts are inserted, and the end faces of the remaining projection act as stoppers which abut the inserted mounting nuts to position them. The upper walls of the duct above the receiving portions are cut off to form slits opening to the upper face of the base. The slits act as mounting bolt passages of the rodless cylinder. The rodless cylinder is coupled to the base by inserting mounting bolts through bolt holes on end caps disposed on both ends of the cylinder. The bolts further pass through the slits and engage the mounting nuts placed in the receiving portions. By tightening the mounting bolt, the rodless cylinder is firmly coupled to the base.

20 Claims, 9 Drawing Sheets

COUPLING CONSTRUCTION BETWEEN AN ACTUATOR AND A BASE

BACKGROUND OF THE INVENTION

1. Field of the Invention

The present invention relates to a coupling construction between an actuator and a base, and a linear actuator device using such a coupling construction.

2. Description of the Related Art

A rodless cylinder which has an internal moving body moving axially within a cylinder tube and an external moving body driven by the internal moving body through a axially extending slit on the wall of the cylinder tube is known in the art. A linear actuator using a rodless cylinder is also known. Generally, a linear actuator includes an elongated base on which a rodless cylinder is rigidly coupled, and a slide body driven by the rodless cylinder and moving back and forth on the base along a longitudinal axis of the base.

A linear actuator of this type is disclosed in various publications.

For example;

(A) Japanese Design registration Publication No. 798741 discloses a linear actuator in which a rodless cylinder is coupled to its base using L-shaped brackets.

More specifically, in the linear actuator of the '741 publication, an L-shaped bracket is provided on each of the end caps attached to either end of the rodless cylinder. The rodless cylinder is coupled rigidly to the base by fastening the L-shaped brackets to the base using mounting bolts. The mounting bolts are screwed into the base in a direction perpendicular to the upper face of the base in order to fasten the bracket to the base.

(B) Japanese Unexamined Patent Publication (Kokai) No. 8-210311 discloses a coupling construction between a rodless cylinder and a base using a T-shaped groove formed on the upper face of the base. In the '031 publication, grooves having a T-shaped cross section are formed on the upper face of the base at the portion where the rodless cylinder is to be mounted. The grooves extend in the direction along the longitudinal axis of the base. The rodless cylinder is fixed to the base by tightening mounting nuts to bolts disposed in the groove and projecting upwardly therefrom. In other words, the mounting nuts are screwed into the bolts from the direction perpendicular to the upper face of the base.

(C) Japanese Patent No. 2502856 and Japanese Unexamined Patent Publication (Kokai) No. 9-177717 discloses a linear actuator provided with a position sensor for detecting the position of the slide body. In these publications, a groove is formed on the side wall of the base for fitting the position sensor directly to the base.

(D) Japanese Unexamined Patent Publication (Kokai) No. 59-227351 also discloses a linear actuator provided with a position sensor. In this publication, a sensor rail for mounting the position sensor is attached to the side wall of the base. The sensor rail extends in the longitudinal direction of the base and is attached to the side wall of the base by fitting bolts screwed into the side wall from the transverse direction (i.e., the direction along the width of the base).

However, in the publication (A), since the mounting bolts are directly screwed into the base, the threads of the bolt holes formed on the base tend to deform or break due to the tightening force of the bolts when the base is made of relatively soft material such as aluminum alloy.

When deformation or breakage of the threads occurs, the rigid coupling between the rodless cylinder and the base is lost.

Further, in this type of the coupling construction, tapped holes for the mounting bolts must be formed on the upper face of the face perpendicularly thereto. This requires machining such as drilling and tapping from a vertical direction (i.e., the direction perpendicular to the upper face of the base). Therefore, if other machining works from the horizontal direction (i.e., the longitudinal direction or the transverse direction of the base) is required, for example, in order to form other tapped holes for mounting end plates at both longitudinal ends of the base, the base must be machined from two different directions. This increases the steps and setup time required for the machining of the base.

In the coupling construction in the publication (B), a pair of T-shaped grooves extending along the entire length of the base are required for coupling the rodless cylinder to the base. Since these grooves extend along the entire length of the upper face of the base, the strength and the rigidity of the base are significantly lowered by these grooves.

In the linear actuator of the publication (C), the sensor rail in the form of a groove is formed on the side wall of the base. Therefore, distortion of the base due to the difference in thickness may occur in the portion where the groove is formed when the base is formed by a drawing or extrusion process. Further, since the sensor rail is formed as an integral part of the base, a larger size die is required for forming the base by a drawing or an extrusion process.

In the linear actuator of the publication (D), the tapped hole for fitting the sensor rail must be machined from the transverse direction. Therefore, if the machining of the tapped hole is required for fitting the end plate, the base must be machined from two different directions (i.e., from the transverse direction and the longitudinal direction). This also increases the steps and setup time required for the machining of the base. Further, the length of the base varies in accordance with the purpose of usage of the linear actuator. Since the longitudinal distance between the tapped holes must be determined in accordance with the length of the base, the machining of the tapped hole for fitting the sensor rail in the publication (C) is complicated.

SUMMARY OF THE INVENTION

In view of the problems in the related art as set forth above, one of the objects of the present invention is to provide a coupling construction between an actuator and a base which does not lower the strength and rigidity of the base.

Another object of the present invention is to provide a coupling construction in which the machining of the base is greatly simplified.

A further object of the present invention is to provide a coupling construction in which distortion of the base does not occur even if the base is formed by a drawing or extrusion process and, at the same time, the size of the die used for the drawing or the extrusion process can be reduced.

One or more of the objects as set forth above are achieved by a coupling construction between the base and an actuator for driving a slide body guided along the longitudinal direction of the base comprising, a hollow receiving portion formed in the base at each longitudinal end face of the base and opening to each longitudinal end face, a mounting nut inserted into each of the receiving portions from the opening thereof on the longitudinal end face of the base, a stopper formed in the receiving portion which abuts the inserted mounting nut in order to position the mounting nut in the longitudinal direction, a mounting bolt passage formed in the base and connecting the receiving portion and the upper face of the base, a mounting bolt screwed into the mounting nut in the receiving portion in such a manner that the mounting bolt passes through an engaging portion formed on the actuator and the mounting bolt passage and that the actuator is firmly coupled to the base through the engaging portion by tightening the mounting bolt.

According to the present invention, the mounting nut, which is a separate from the base, is used to tighten the mounting bolt. Since the mounting nut can be made from material having greater strength than that of the base, higher tightening torque can be applied to the mounting bolt in order to obtain firm coupling between the base and the actuator. Further, in the present invention, since only relatively small openings for the mounting bolt passages on the receiving portions are formed on the upper face of the base, i.e., grooves extending along the entire length of base are not formed on the upper face of the base, the strength and the rigidity of the base are greatly increased.

BRIEF DESCRIPTION OF THE DRAWINGS

The present invention will be better understood from the description, as set forth hereinafter, with reference to the accompanying drawings, of which.

DESCRIPTION OF THE PREFERRED EMBODIMENT

Figure 1:
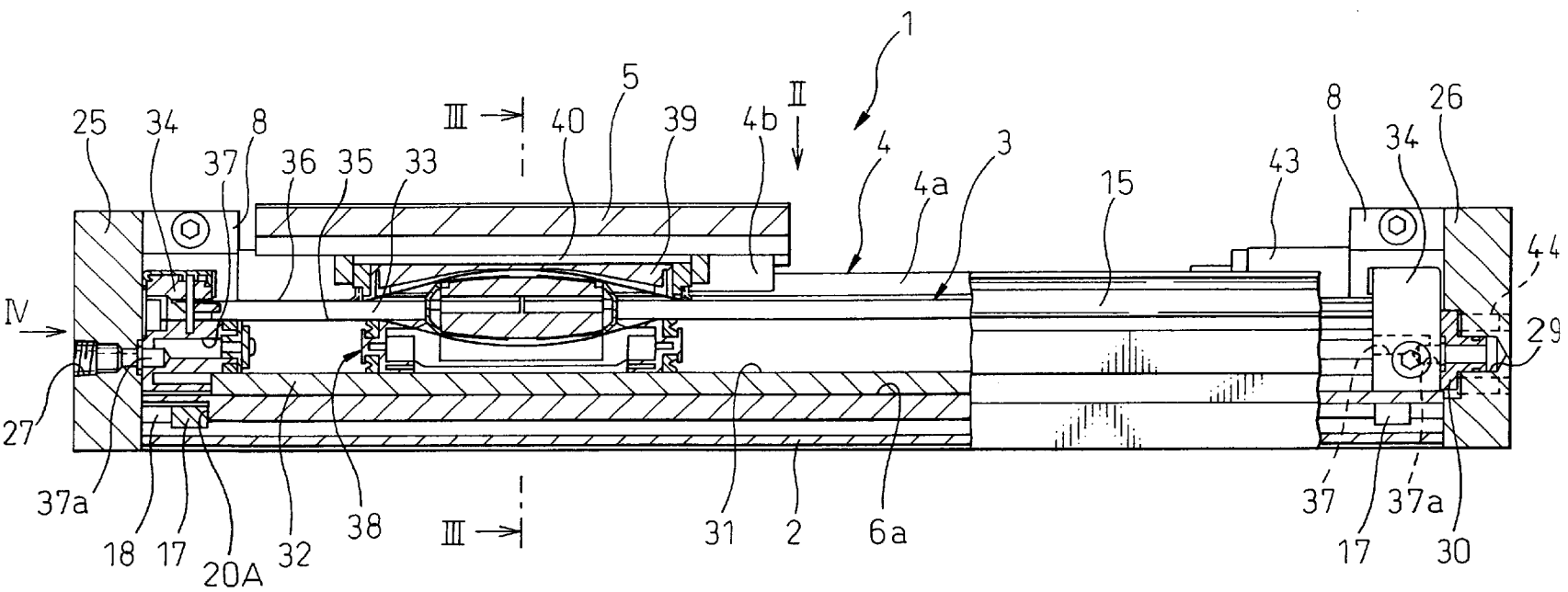
FIG. 1 is a side view of a linear actuator according to an embodiment of the present invention showing a partial longitudinal section of a rodless cylinder.

Hereinafter, embodiments of the present invention will be explained with reference to FIGS. 1 through 9.

FIGS. 1 through 5 illustrate an embodiment of a linear actuator provided with a coupling construction between an actuator and a base according to the present invention.

In FIGS. 1 through 5, reference numeral 1 designates a linear actuator as a whole. The linear actuator 1 includes a base 2, a rodless cylinder acting as an actuator, slide body 5 and a linear guide 4 for guiding the movement of the slide body along the longitudinal direction of the base 2.

Figure 6:
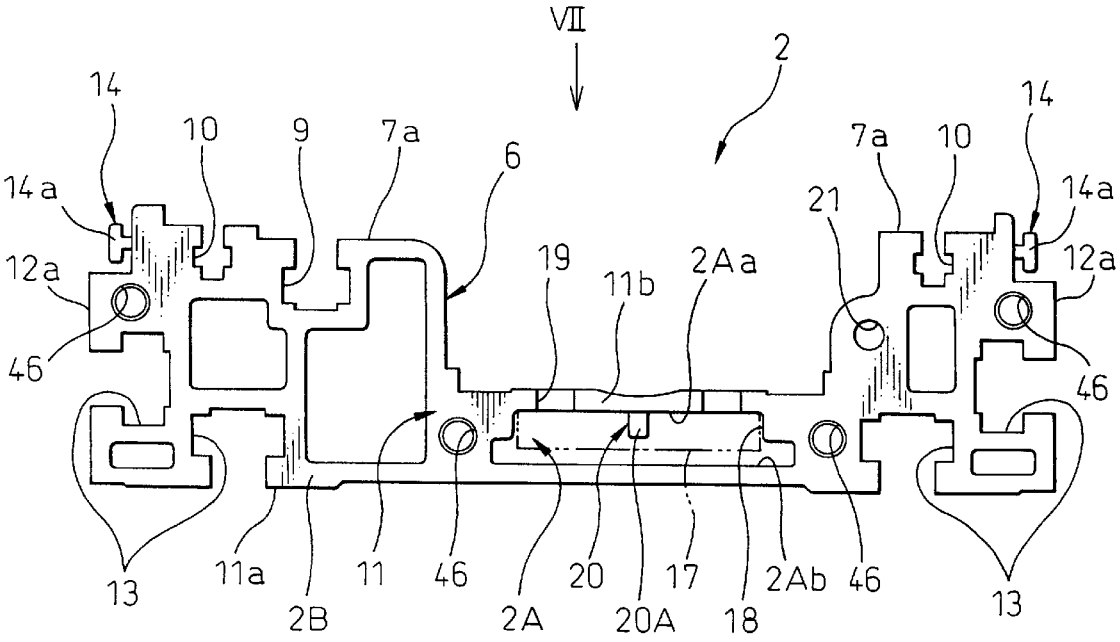
FIG. 6 is an end view of the base of the linear actuator in FIG. 1.

The base 2 is made of aluminum alloy and has a roughly U-shaped cross section as shown in FIG. 6. In this embodiment, the base 2 is formed, for example, by an extrusion or drawing process. On the bottom portion 11 of the base 2 which corresponds to the horizontal U-shaped bar, a mounting recess 6 into which a rodless cylinder 3 is fitted extends in the longitudinal direction of the base 2.

Figure 2:
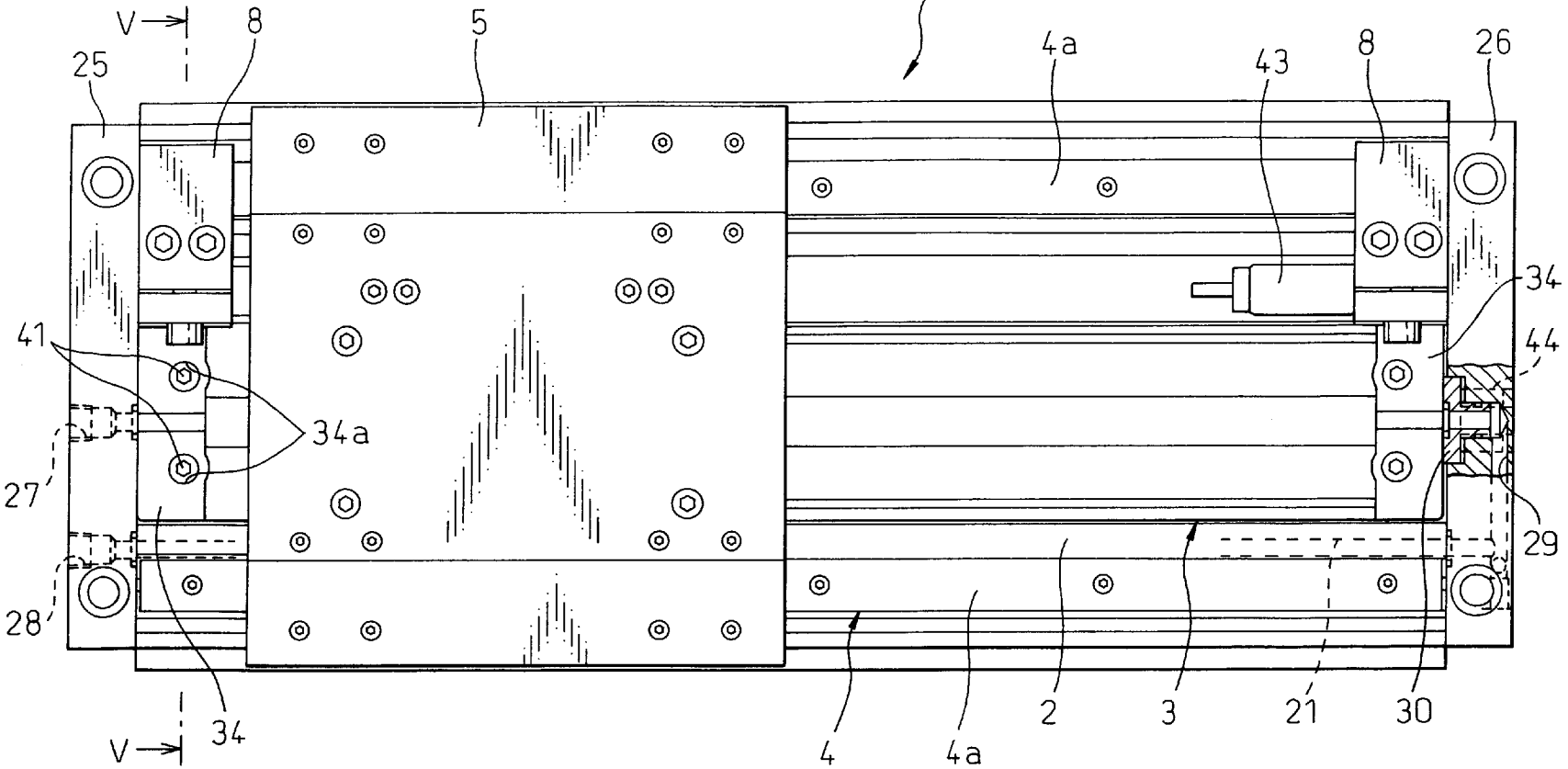
FIG. 2 is a plan view of the linear actuator in FIG. 1.
Figure 7:
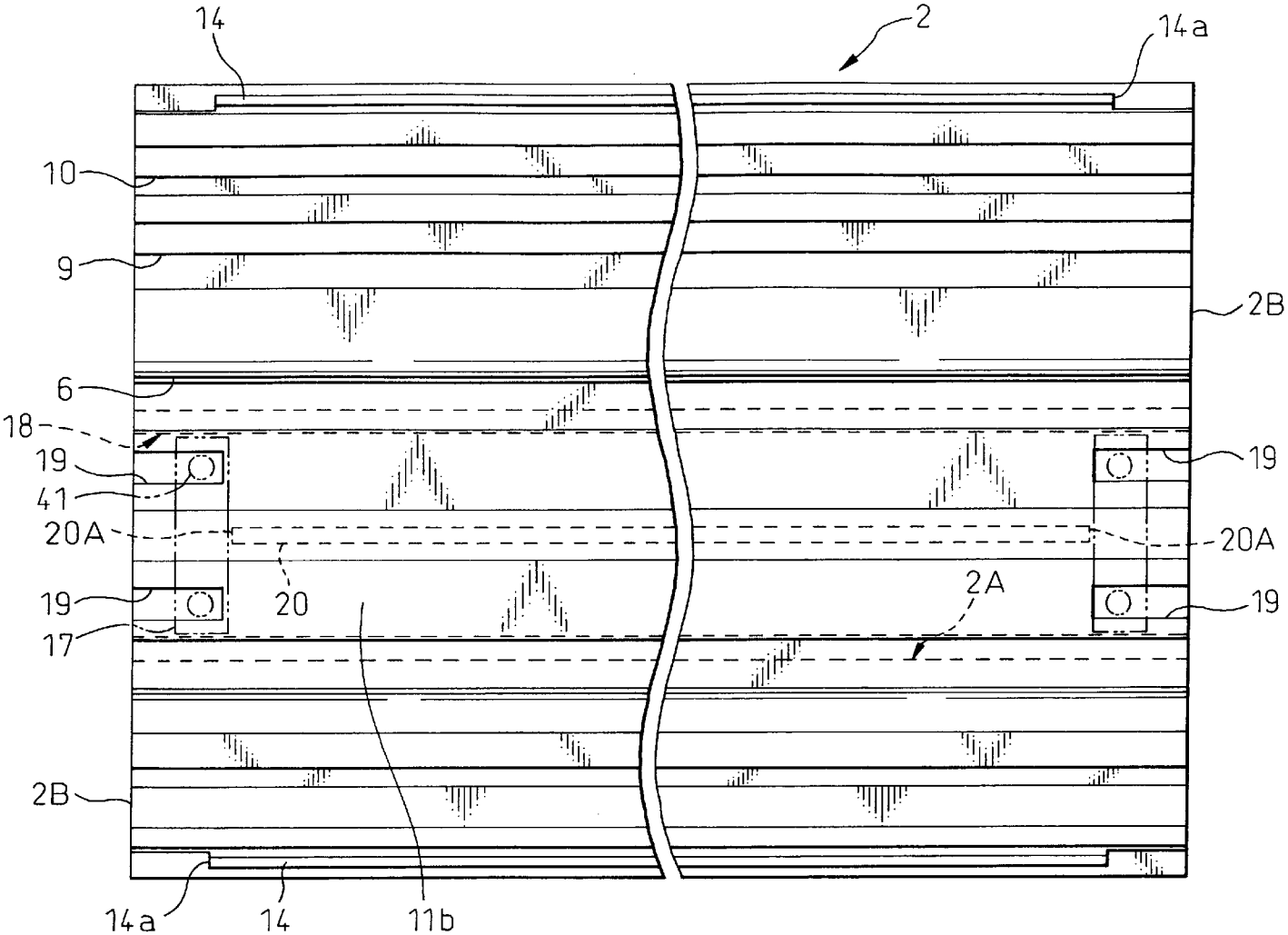
FIG. 7 is a view taken along the direction VII in FIG. 6.

As shown in FIGS. 6 and 7, a T-groove 9 having a T-shaped cross section which extends along the entire length of the base is formed on one of upper faces 7*a* of side wall portions (which correspond to the vertical bars of the U-shape) for fitting an attachment holder 8 (FIG. 2). A T-groove 10 for fitting a guide rail 4*a* of the linear guide 4 (FIG. 2) is formed on the upper face 7*a* of each side wall portions of the base 2. T-grooves 13 for mounting the linear actuator 1 on a mounting structure (not shown) are formed on the bottom face 11*a*, as well as on the outer walls 12*a* of the side wall portions of the base 2 and extend along the entire length thereof. When end plates 25 and 26 (FIGS. 1 and 2) are attached to both longitudinal ends of the base 2, the end openings of the T-grooves 13 are covered by the end plates.

Therefore, a predetermined number of mounting nuts 47 (FIGS. 3 and 5) used for mounting the linear actuator on the mounting structure are inserted into the T-grooves 13 before the end plates 25 and 26 are attached to the ends of the base 2.

Further, a projection 14 having a T-shaped cross section is formed on the upper part of each of the outer walls 12*a* of the side wall portions. The T-shaped projections 14 are used for fitting sensor rails 15 to the base 2. The T-shaped projections 14 are formed as integral parts of the base 2 extending along the entire length thereof. Further, as shown in FIG. 7, both longitudinal end portions of the T-shaped projections 14 are cut off by a predetermined length after the base 2 is formed. The length of the cut-off portions are determined in such a manner that the ends of fixing screws 16 (FIG. 4) and the end faces 14*a* of the remaining portions of the T-shaped projections 14 do not interfere with each other when the fixing screws 16 are screwed into the ends of sensor rails 15, as explained later.

Figure 3:
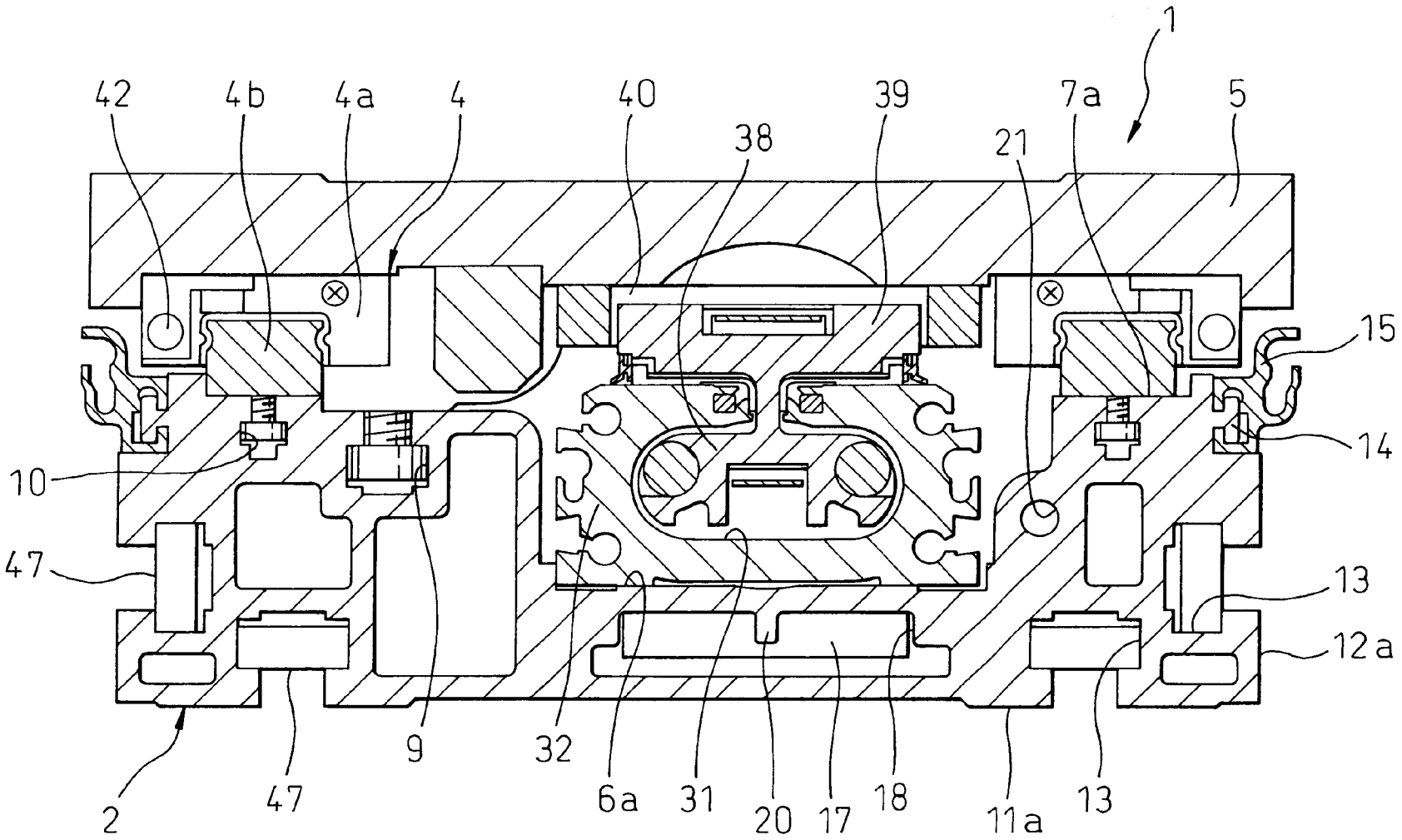
FIGS. 3 is a cross sectional view taken along the line III—III in FIG. 1.
Figure 4:
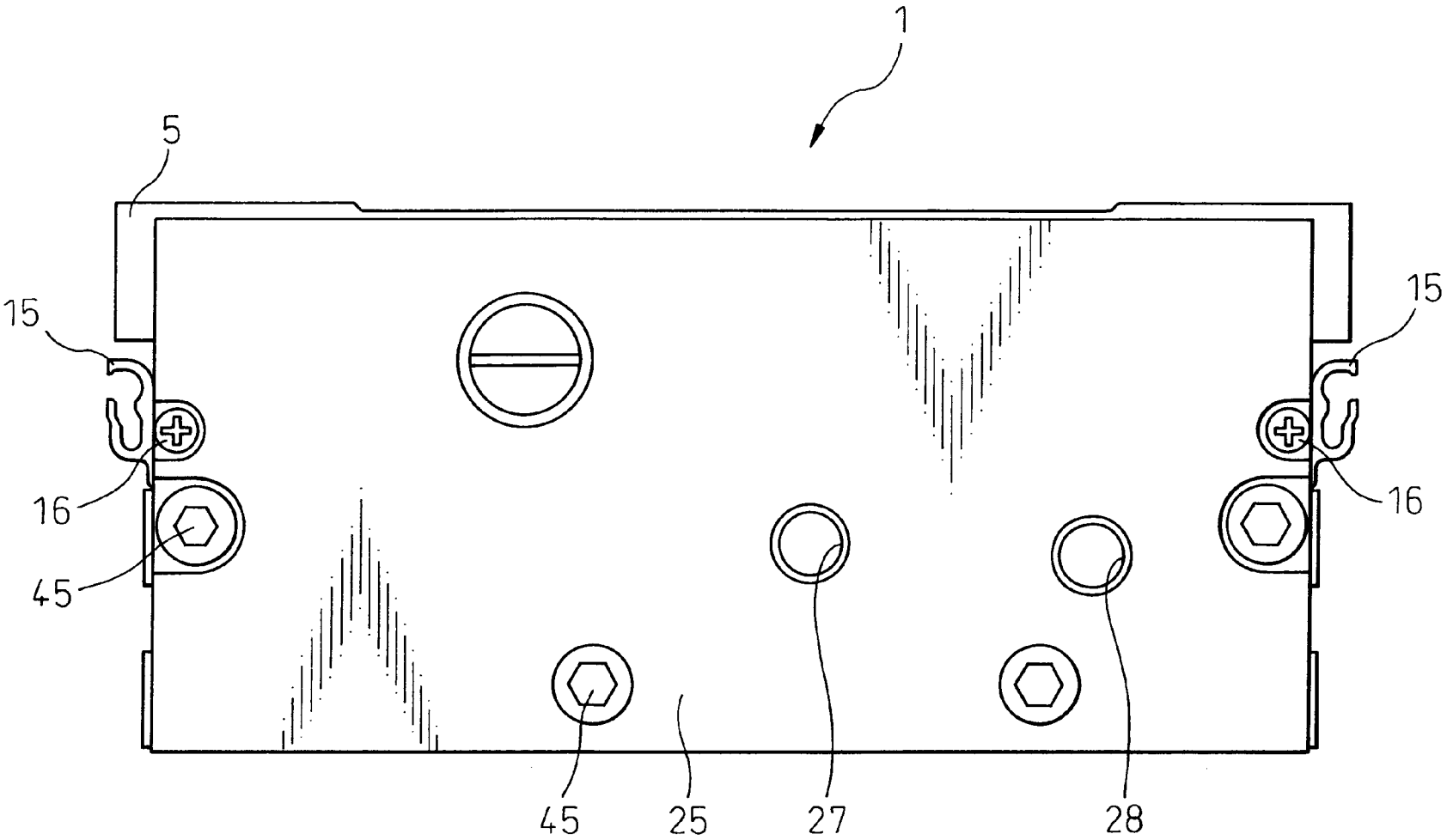
FIG. 4 is an end view of the linear actuator taken along the direction IV in FIG. 1.
Figure 5:
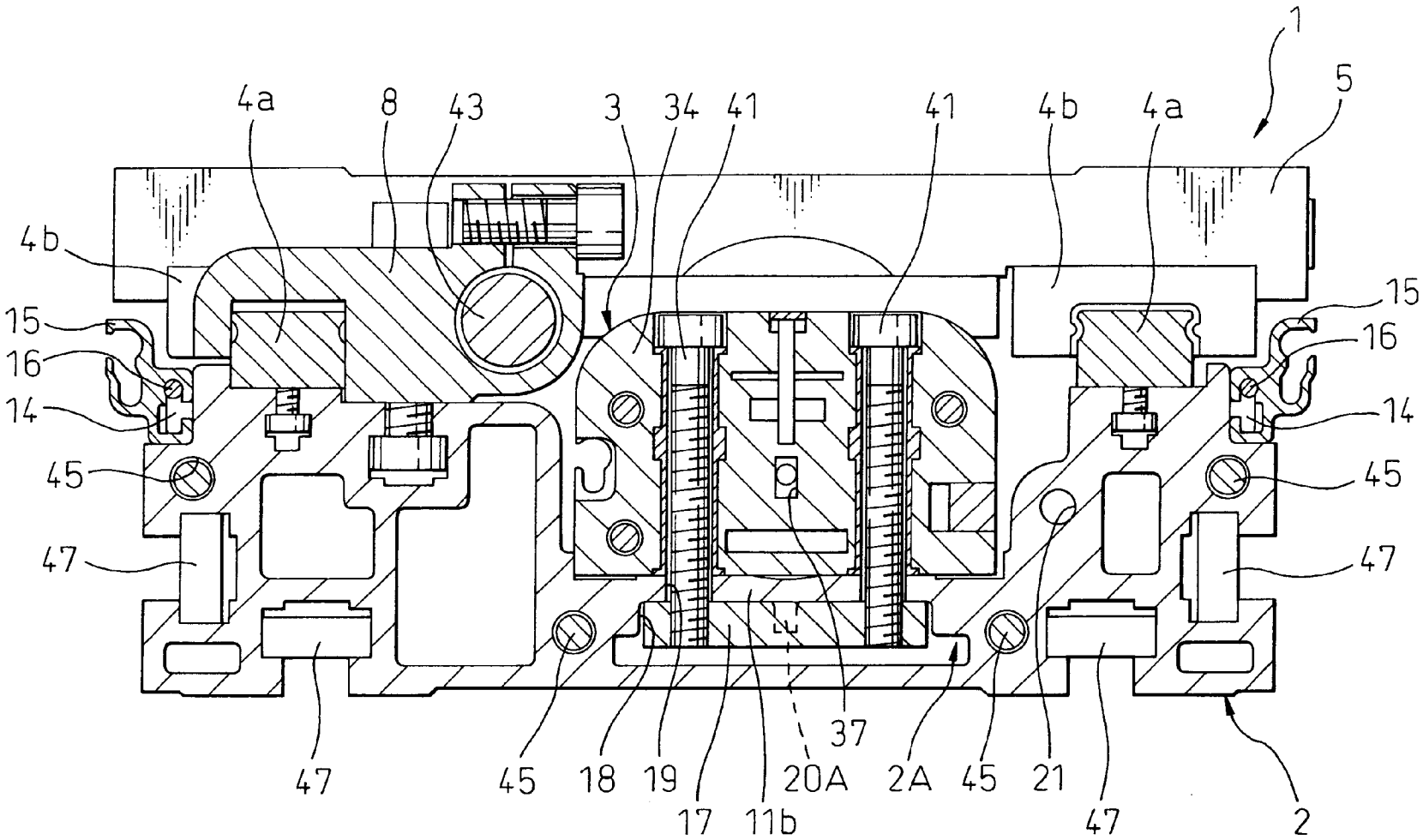
FIG. 5 is a cross sectional view taken along the line V—V in FIG. 2.

In this embodiment, a duct 2A having a rectangular cross section and extending along the entire length of the base is formed in the bottom portion 11 of the base 2 (FIGS. 6 and 7). Further, a downward projection 20 extending along the entire length of the duct 2A is integrally formed on the upper face 2A*a* of the inner wall of the duct 2A. The height of the projection 20 is determined so that the distance between the bottom end of the projection 20 and the lower face 2A*b* of the inner wall of the duct 2A is less than the thickness of cylinder nuts 17. Further, both longitudinal end portions of the projection 20 are cut off by a predetermined length after the base 2 is formed. Both longitudinal end portions of the duct 2A from which the projection 20 is cut off form nut-receiving portions 18 (FIGS. 3 and 5). Since the projection 20 is removed from the receiving portion 18, the cylinder nuts 17 having a thickness greater than the distance between the projection 20 and the lower face 2A*b* of the duct can be inserted into the receiving portions 18 from both longitudinal ends of the duct 20A. The cylinder nuts 17 used for coupling the rodless cylinder 3 and the base 2 have a rectangular cross section. Therefore, the longitudinal position of the cylinder nuts 17 is determined by inserting the nuts 17 from the end opening of the duct 20*a* into the receiving portion 18 until the side face of the nuts 17 abuts the end face 20A of the remaining portion of the projection 20. In other words, the longitudinal end faces 20A of the remaining projection 20 act as stoppers for positioning the cylinder nuts 17 on the base 2. When the end plates 25, 26 are attached to the longitudinal ends of the base 2, the cylinder nuts 17 are held between the stopper 20A and the end plates. In this state, the thread holes of the nuts 17 align through bolt holes 34*a* formed in the end caps 34 of the rodless cylinder 3 when the rodless cylinder 3 is fitted into the mounting recess 6 of the base 2 (FIG. 1). Further, upper walls 11*b* of the duct 20A are cut off at the nut-receiving portions 18 in such a manner that slits 19 having open ends at both longitudinal ends of the base 2 are formed above the thread holes of the cylinder nuts 17 (FIG. 7). Mounting bolts 41 are screwed into the thread holes of the cylinder nuts 17 through the bolt holes 34*a* and the slits 19 in order to couple the rodless cylinder 3 and the base 2 (FIG. 5). Tapped holes 46 are formed on both longitudinal end faces 2B of the base 2 (FIG. 6). End plates 25 and 26 are attached to the end faces 2B by screwing fitting bolts 45 (FIG. 4) into the tapped holes 46.

As explained above, the T-shaped projections 14 for fitting the sensor rails 15, the projection 20 in the duct 2A, the slits 19 for mounting bolts 41 and the tapped holes 46 for attaching the end plates all extend in the longitudinal direction in this embodiment. Therefore, the cutting off of the ends of T-shaped projections 14 and the projection 20, machining of the slits 19 and the tapping of the holes 46 can all be done from the longitudinal direction using cutting tools having spindles directed to the longitudinal direction of the base. Further, the portions of the base 2 to be machined are all located at the ends of the base 2 in this embodiment. Therefore, in the present embodiment, the setup time required for each machining work is greatly reduced.

In this embodiment, the slits 19 are cut off from the upper wall 11*b* of the base 2. However, the slits 19 are disposed only at the portions near the longitudinal ends of the base 2, i.e., no opening or groove extending along the entire length of the base is formed on the upper surface of the upper wall 11*b* of the base in this embodiment. Therefore, the strength and the rigidity of the base 2 are greatly increased compared to the conventional coupling construction disclosed in, for example, the publication (B).

Figure 8:
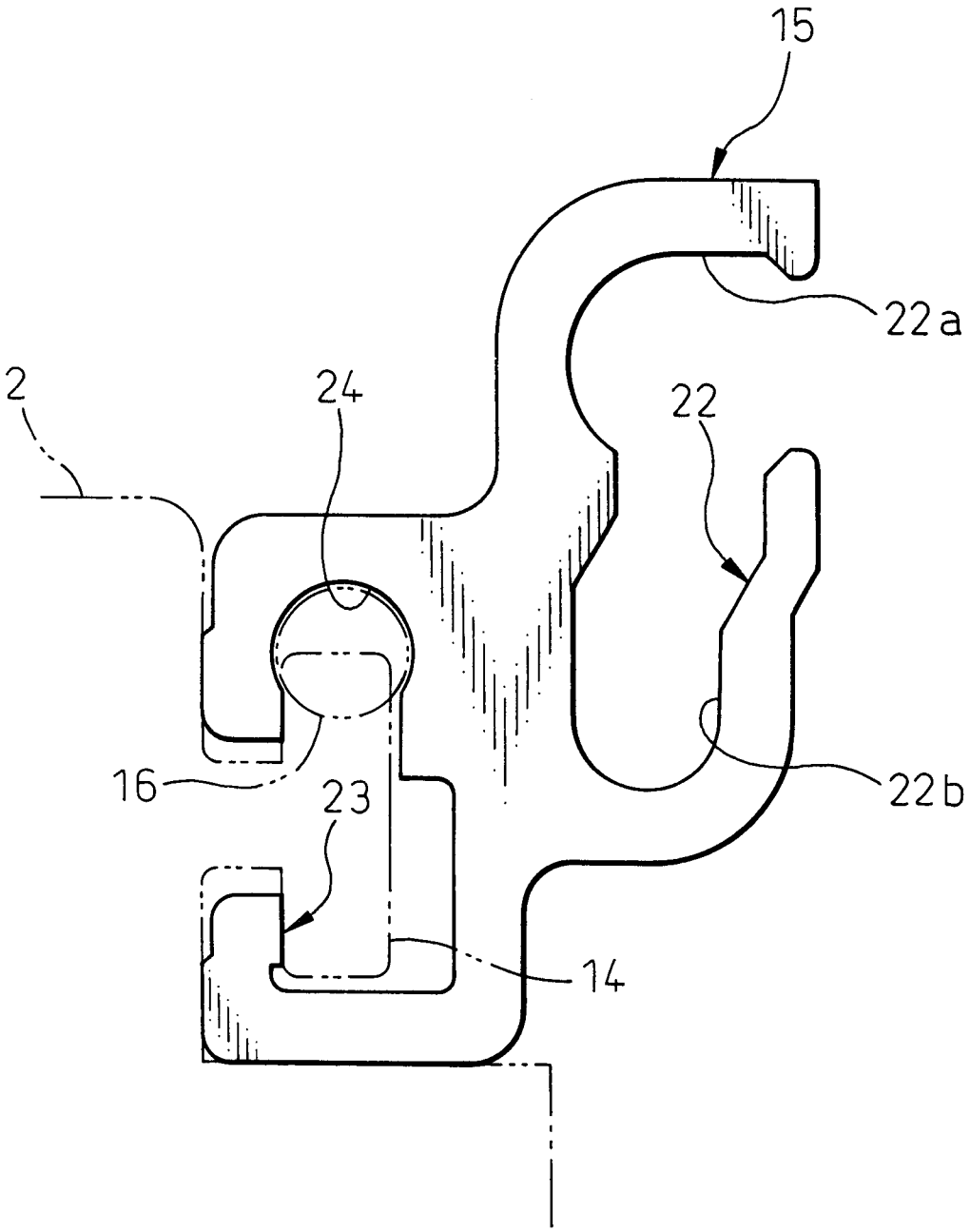
FIG. 8 is an end view of the sensor rail of the linear actuator in FIG. 1.

Next, the method for fitting the sensor rail will be explained. FIG. 8 shows the end view of the sensor rail 15 when it is fitted to the T-shaped projection 14 on the outer wall 12*a* of the side wall portion of the base 2. The sensor rail 15 is made of aluminum alloy and the length thereof is about the same as that of the base 2. The sensor rail 15 in this embodiment is formed separately by a drawing or extrusion process similar to that used for forming the base 2. However, the sensor rail 15 may be formed by other processes, such as machining or pressing.

The sensor rail 15 has an engaging groove 23 for engaging with the T-shaped projection 14 of the base 2 and a sensor groove 22 both extending along the entire length of the rail 15. The engaging groove 23 has a cross-sectional shape complementary to the cross section of the T-shaped projection 14. A screw hole 24 extending along the entire length of the rail 15 is formed on a part of the cross section of the engaging groove 23. The sensor groove 22 consists of a sensor fitting portion 22*a* to which a sensor is attached and a wire conduit portion 22*b* for holding lead wires of the sensor. The sensor rail is fitted to the base 2 by inserting the T-shaped projection 14 of the base 2 into the engaging groove 23 in the longitudinal direction. The sensor rail 15 may be attached to one side of the base 2, or both sides thereof, as required. When the end plates 25 and 26 are attached to both ends of the base 2, the sensor rail 15 is held between the end plates 25 and 26. Further, the sensor rail is rigidly fixed to the end plates 25 and 26 by screwing fixing screws 16 into the screw hole 24 from outside of the endplates 25 and 26.

On one of the end plates (the end plate 25 in FIGS. 1 and 2), two inlet/outlet ports 27, 28 penetrating the end plate 25 are provided. In the end plate 26, an air passage 29 having an inlet/outlet port opening on the inner face (the face opposing the other end plate 25) is formed. The axis of the inlet/outlet port of the air passage 29 on the end plate 26 aligns with the axis of the inlet/outlet port 27 of the end plate 25. A stepped diameter end pipe 30 having a larger outer diameter portion and a smaller outer diameter portion is disposed on the inner face of the end plate 26 in such a manner that the smaller outer diameter portion of the end pipe 30 is inserted into the inlet/outlet port of the air passage 29.

When the end plates 25 and 26 are attached to the base 2, the air passage 29 communicates with the inlet/outlet port 28 of the end plate 25 through an air passage 21 formed in the base 2 (FIG. 6). Further, a pair of adjusting bolts 44 for urging the larger outer diameter portion of the end pipe 30 toward the end cap of the rodless cylinder 3 after the rodless cylinder 3 is fitted in the mounting recess 6 of the base 2 are provided on the end plate 26 at both side of the inlet/outlet port of the air passage 29.

The rodless cylinder 3 which is fitted in the mounting recess 6 between the end plates 25, 26 is a known type, such as the rodless cylinder disclosed in Japanese Unexamined Patent Publication (Kokai) No. 10-299714. The rodless cylinder 3 can be used as an actuator by itself without being coupled to the base.

The rodless cylinder 3 includes a cylinder tube 32 having a cylinder bore 31. A slit 33 penetrating the wall of the cylinder tube 32 and extending along the axis of the tube 32 over the entire length thereof is formed on the wall of the cylinder tube 32. An end cap 34 is attached to each end of the cylinder tube 32 in order to close both ends of the bore 31. Inner seal band 35 and outer seal band 36 in the shape of thin metal band are disposed along the slit 31 in order to cover the opening of the slit 33 from inside and outside of the cylinder tube 32, respectively. The ends of the inner and outer seal bands are fixed on the end caps 34. An inlet/outlet port 37 is formed on the inner face of each end cap 34.

A piston 38 is disposed in the cylinder bore 31 and is movable in the direction along the axis of the tube 32.

The upper portion of the piston extends outward through the slit 33 and forms a piston mount 39 outside of the tube 32. A mount cover 40 is provided on the piston mount 39. The piston mount 39 and the mount cover 40 form an external moving body of the rodless cylinder 3.

In the end caps 34, air passages 37*a* are formed in such a manner that when the rodless cylinder 3 is fitted on the mounting recess 6 between the end plates 25, 26, the inlet/outlet ports 37 communicate with the inlet/outlet port 27 of the end plate 25 and the end pipe 30 on the end plate 26, via the respective air passages 37*a*. After the rodless cylinder 3 is fitted into the mounting recess 6 of the base 2, the end pipe 30 is pressed against the end cap 34 of the rodless cylinder 3 by the adjusting bolts 44, as explained later.

The rodless cylinder 3 is coupled to the base 2 after the position of the end pipe is adjusted by the adjusting bolt. In order to couple the rodless cylinder 3 to the base 2, the mounting bolts 41 are inserted into the bolt holes 34*a* formed on the end caps 34 in the vertical direction to the base 2. As explained before, the thread holes of the cylinder nuts 17 are positioned by the stopper 20A in such a manner that the thread holes of the nuts 17 aligns slits 19 and bolt holes 4*a*. Therefore, the mounting bolts 41 can be screwed into the cylinder nuts 17 easily in the direction vertical to the base 2.

In this embodiment, the cylinder nuts 17 are made of a material, such as steel, having a greater strength than the base 2. Therefore, deformation of the threads of the nuts 17 does not occur when the mounting bolts 41 are fully tightened. This prevents loosening of the bolts 41 and ensures a rigid coupling between the rodless cylinder 3 and the base 2. Further, since the cylinder nuts 17 are positioned by the stoppers 20A, it is not required to form tapped holes on the upper face of the base 2 for receiving the mounting bolts 41 in such a manner that the longitudinal distance between the tapped holes exactly match those of the bolt holes 34*a*. Thus, the machining of the base is greatly simplified.

Usually, the length of the rodless cylinder 3 is slightly less than the distance between the end plates 25 and 26. Therefore, small clearances remain between the end plates 25, 26 and the end caps 34 of the rodless cylinder, when the rodless cylinder 3 is fitted into the mounting recess 6. This may cause leakage of pressurized fluid supplied to the cylinder tube 32 from the air passages in the end plates 25 and 26. In this embodiment, the adjusting bolts 44 are tightened to press the end pipe 30 to the end cap 34 of the rodless cylinder 3. By doing so, the entire rodless cylinder 3 is urged to the end plate on the opposite side of the rodless cylinder 3 (i.e., the end plate 25 in FIG. 1). Therefore, the end plate 25 and the end cap 34, as well as the end pipe 30 and the other end cap 34, are in close contact with each other. Thus, leakage of fluid from the clearances between the end caps 34 and the end plates 25, 26 does not occur in this embodiment. Further, according to the present embodiment, since both inlet/outlet ports 27 and 28 are disposed on one of the end plates (i.e., the end plate 25 in FIG. 1), the connection of the pressurized fluid to the linear actuator 1 is greatly simplified.

A slide body 5 is connected to the external moving body for moving together with the external moving body. The slide body 5 is provided with guide members 4*b* which slide on the guide rails 4*a* of the linear guide 4. The guide rails 4*a* are fixed on the upper faces 7*a* of the side wall portions of the base 2 by the T-grooves 10.

A magnet 42 for a position sensor is attached on the bottom face of the slide body 5 (FIG. 3). An attachment holder 8 holding a shock absorber 43 is fixed in the T-groove 9 at each end thereof. When the pressurized fluid (pressurized air) is supplied to the cylinder bore 31 through the inlet/outlet ports 27 and 28, the slide body 5 moves back and forth with the movement of the piston 38 in the bore 31. The position of the slide body 5 in the longitudinal direction is detected by sensing the magnet 43 under the slide body 5 by the position sensor fixed to the sensor rail at a predetermined position thereof.

Figure 9:
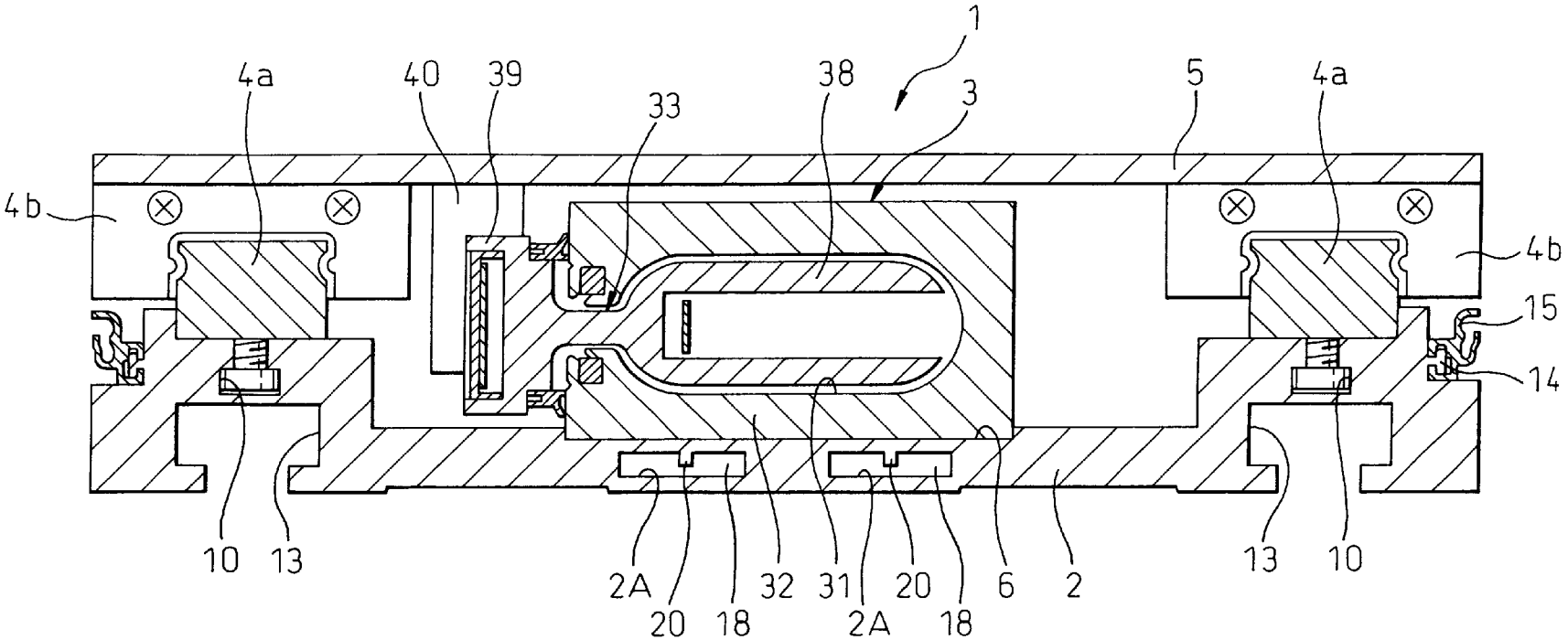
FIG. 9 is a cross sectional view of a linear actuator according to another embodiment of the present invention.

FIG. 9 illustrates another embodiment of a linear actuator having a coupling construction according to the present invention.

In FIG. 9, a tube 32 of a rodless cylinder 3 has, a non-circular (oblong circular) bore 31. In this embodiment, the rodless cylinder 3 is fitted to the base 2 in such a manner that the major diameter of the oblong circular bore 31 is placed in parallel with the base 2. In this embodiment, a slit 33 is formed on the tube wall where the major diameter of the bore 31 intersects with the tube wall (on the side of the cylinder tube 32). In addition, the rodless cylinder 3 is fitted into a mounting recess 6 formed on the base 2 at the middle of the width thereof. Raised portions for fitting guide rails 4*a* are formed on the base 2 on both sides of the mounting recess 6. Guide members 4 sliding on the guide rails 4*a* are attached to the bottom face of the slide body 5 and guide the movement of the slide body 5 along the guide rails 4*a*.

Numeral 13 designates T-grooves for mounting the linear actuator on an external structure (not shown). Though not illustrated in FIG. 9, end plates similar to those in the previous embodiment are disposed on both ends of the base 2.

In this embodiment, a pair of ducts 2A extending along the entire length of the base 2 are formed in the bottom wall of the mounting recess 6. Further, a projection 20 extending along the entire length of the base 2 is formed as an integral part of the base 2 on the upper wall inner surface of each duct 2A. Both end portions of the projections 20 are cut off by a predetermined length after the base 2 is formed. The portions of ducts 2A where the projections 20 are cut off act as receiving portions 18 of cylinder nuts. The rodless cylinder 3 is coupled to the base by inserting mounting bolts through bolt holes formed on the end caps of the rodless cylinder 3 and by screwing the mounting bolts into the cylinder nuts placed in the receiving portions 18.

According to the present embodiment, advantages the same as the previous embodiment can be obtained by using the coupling construction between the actuator 3 and the base 2. In addition, the slit 33 is formed on the plane including the major diameter of the oblong circular bore 31 and the connection between the piston 38 and the slide body 5 is disposed on the transverse side of the tube 2. Therefore, the distance between the top face of the slide table and the bottom face of the base 2, i.e., the height of the linear actuator 1 is significantly reduced.

As explained in the embodiments described above, according to the present invention, since the actuator is coupled to the base by the engagement between the mounting bolt and the cylinder nut separate from the base, the mounting bolt can be tightened rigidly to the cylinder nut without causing deformation of the treads of the nut. Therefore, loosening of the mounting bolt does not occur.

Further, since the coupling construction of the present invention does not require T-grooves having openings extending along the entire length of the base, the strength and the rigidity of the base are greatly increased.

In addition, the machining of the receiving portions of the cylinder nuts and the stoppers thereof can be done in a condition where the spindles of machine tools are oriented only to the longitudinal direction of the base. Therefore, the step of machining and setup time required are greatly reduced.

Further, since the receiving portions and the stoppers of the cylinder nuts are formed by removing the ends of the projection in the duct formed in the bottom wall of the base, the receiving portions and the stoppers can be formed easily by removing a minimum amount of the material forming the base.

In the present invention, the inlet/outlet ports for supplying/discharging the pressure fluid to/from the actuator are all disposed on one end plate, and thus the piping for the pressure fluid can be simplified. Further, since the connections of the pressure fluid on the actuator are firmly pressed against the end plate and the end pipe, leakage of pressure fluid does not occur in the present invention.

In addition, since the sensor rail is not formed as an integral part of the base in the present invention, deformation of the base due to a difference in the wall thickness does not occur when the base is formed. Lastly, since the sensor rail and the base are formed by, for example, separate drawing or extrusion processes, a smaller size die can be used for forming the base.

In the present invention, the sensor rail is fixed firmly on the base by tightening the fixing screws in the longitudinal direction of the base. Therefore, the fitting of the sensor rail requires only the machining of tapped holes in the longitudinal direction of the base. Since the screw holes for receiving the fixing screws are disposed only on the end faces of the end plates, the same arrangement of screw holes can be used regardless of the length of the base.

What is claimed is:

1. A coupling construction between a base and an actuator for driving a slide body guided along the longitudinal direction of the base, comprising:

a hollow receiving portion formed in the base at each longitudinal end face of the base and opening to each longitudinal end face;

a mounting nut inserted into each receiving portion from the opening thereof on the longitudinal end face of the base;

a stopper formed in the receiving portion which abuts the inserted mounting nut in order to position the mounting nut in the longitudinal direction;

a mounting bolt passage formed in the base and connecting the receiving portion and the upper face of the base;

a mounting bolt screwed into the mounting nut in the receiving portion in such a manner that the mounting bolt passes through an engaging portion formed on the actuator and the mounting bolt passage and that the actuator is firmly coupled to the base through the engaging portion by tightening the mounting bolt.

2. A coupling construction as set forth in claim 1, wherein the mounting bolt passage is in the form of a slit extending along the longitudinal direction and having a top opening on the upper face of the base and a bottom opening on the upper inner wall of the receiving portion and a slit end opening on the longitudinal end face of the base.

3. A coupling construction as set forth in claim 2, wherein the mounting bolt passage is formed by removing the material of the base from the portion above the receiving portion using a cutting tool having a spindle oriented to the longitudinal direction of the base.

4. A coupling construction as set forth in claim 1, wherein the base is formed by a drawing or extrusion process, and wherein the receiving portions and the stoppers are formed by a process including steps of:

forming a hollow duct in the base extending along the entire length thereof and a projection extending on the upper inner wall face of the hollow duct along the entire length thereof when the base is formed by the drawing or extrusion process;

removing the projections by a predetermined length thereof from both longitudinal ends of the duct so that the end portions of the duct from which the projections are removed act as receiving portions for receiving mounting nuts and both ends of the remaining portion of the projection act as stoppers for abutting the mounting nuts when the nuts are inserted into the receiving portions.

5. A coupling construction as set forth in claim 2, wherein the base is formed by a drawing or extrusion process, and wherein the receiving portions and the stoppers are formed by a process including steps of:

forming a hollow duct in the base extending along the entire length thereof and a projection extending on the upper inner wall face of the hollow duct along the entire length thereof when the base is formed by the drawing or extrusion process;

removing the projections by a predetermined length thereof from both longitudinal ends of the duct so that the end portions of the duct from which the projections are removed act as receiving portions for receiving mounting nuts and both ends of the remaining portion of the projection act as stoppers for abutting the mounting nuts when the nuts are inserted into the receiving portions.

6. A coupling construction as set forth in claim 3, wherein the base is formed by a drawing or extrusion process, and wherein the receiving portions and the stoppers are formed by a process including steps of:

forming a hollow duct in the base extending along the entire length thereof and a projection extending on the upper inner wall face of the hollow duct along the entire length thereof when the base is formed by the drawing or extrusion process;

removing the projections by a predetermined length thereof from both longitudinal ends of the duct-so that the end portions of the duct from which the projections are removed act as receiving portions for receiving mounting nuts and both ends of the remaining portion of the projection act as stoppers for abutting the mounting nuts when the nuts are inserted into the receiving portions.

7. A linear actuator comprising a base and a rodless cylinder coupled to each other using a coupling construction as set forth in claim 1, wherein the rodless cylinder is disposed on the base along the longitudinal direction of the base and provided with an end cap having an inlet/outlet port for pressure fluid supplied to and discharged from the rodless cylinder on each of longitudinal ends thereof and the base is provided with a first end plate on one longitudinal end thereof and a second end plate on the other longitudinal end thereof, and wherein a pressure fluid piping connection communicating with the inlet/outlet ports on one of the end caps and a pressure fluid piping connection communicating with the other of the end caps are both disposed on the first end plate.

8. A linear actuator comprising a base and a rodless cylinder coupled to each other using a coupling construction as set forth in claim 4, wherein the rodless cylinder is disposed on the base along the longitudinal direction of the base and provided with an end cap having an inlet/outlet port for pressure fluid supplied to and discharged from the rodless cylinder on each of longitudinal ends thereof and the base is provided with a first end plates on one longitudinal end thereof and a second end plate on the other longitudinal end thereof and, wherein a pressure fluid piping connection communicating with the inlet/outlet ports on one of the end caps and a pressure fluid piping connection communicating with the other of the end caps are both disposed on the first end plate.

9. A linear actuator as set forth in claim 7, wherein the second end plate is provided with a pressure fluid port at the position facing and aligning with the inlet/outlet port of the adjacent end cap and an end pipe having one end inserted into the pressure fluid port and the other end being pressed against the inlet/outlet port of the adjacent end cap, and wherein the pressure fluid is supplied from one of the pressure fluid connections on the first end plate to the inlet/outlet port on the adjacent end cap through a passage connecting the pressure fluid connection on the first end plate to the pressure fluid port on the second end plate and through the end pipe.

10. A linear actuator as set forth in claim 8, wherein the second end plate is provided with a pressure fluid port at the position facing and aligning with the inlet/outlet port of the adjacent end cap and an end pipe having one end inserted into the pressure fluid port and the other end being pressed against the inlet/outlet port of the adjacent end cap, and wherein the pressure fluid is supplied from one of the pressure fluid connections on the first end plate to the inlet/outlet port on the adjacent end cap through a passage connecting the pressure fluid connection on the first end plate to the pressure fluid port on the second end plate and through the end pipe.

11. A linear actuator comprising a base and an actuator coupled to each other using a coupling construction as set forth in claim 1, wherein an engaging portion which engages with a sensor rail for a sensor is formed as an integral part of the base and the sensor rail is formed as a part separate from the base which is fitted to the engaging portion.

12. A linear actuator as set forth in claim 11, wherein the sensor rail has a length the same as the length of the base and held between end plates attached to the longitudinal ends of the base and fixed in position by tightening a fixing screw which extends through the end plates in the longitudinal direction of the base.

13. A linear actuator as set forth in claim 7, wherein the rodless cylinder is provided with a slit on the cylinder wall at a side portion between the top and bottom of the cylinder and extending in parallel with the longitudinal axis of the rodless cylinder, and wherein the slide body and a piston of the rodless cylinder are connected to each other through the slit at a height from the base substantially the same as the height of the slit from the base.

14. A linear actuator as set forth in claim 8, wherein the rodless cylinder is provided with a slit on the cylinder wall at a side portion between the top and bottom of the cylinder and extending in parallel with the longitudinal axis of the rodless cylinder, and wherein the slide body and a piston of the rodless cylinder are connected to each other through the slit at a height from the base substantially the same as the height of the slit, from the base.

15. A linear actuator as set forth in claim 9, wherein the rodless cylinder is provided with a slit on the cylinder wall at a side portion between the top and bottom of the cylinder and extending in parallel with the longitudinal axis of the rodless cylinder, and wherein the slide body and a piston of the rodless cylinder are connected to each other through the slit at a height from the base substantially the same as the height of the slit from the base.

16. A linear actuator as set forth in claim 10, wherein the rodless cylinder is provided with a slit on the cylinder wall at a side portion between the top and bottom of the cylinder and extending in parallel with the longitudinal axis of the rodless cylinder, and wherein the slide body and a piston of the rodless cylinder are connected to each other through the slit at a height from the base substantially the same as the height of the slit from the base.

17. A linear actuator as set forth in claim 13, wherein the rodless cylinder comprises a cylinder tube having an oblong circular cross section bore, and wherein the rodless cylinder is coupled to the base so that the major diameter of the oblong circular cross section bore of the cylinder tube is in parallel with the base.

18. A linear actuator as set forth in claim 14, wherein the rodless cylinder comprises a cylinder tube having an oblong circular cross section bore, and wherein, the rodless cylinder is coupled to the base so that the major diameter of the oblong circular cross section bore of the cylinder tube is in parallel with the base.

19. A linear actuator as set forth in claim 15, wherein the rodless cylinder comprises a cylinder tube having an oblong circular cross section bore, and wherein the rodless cylinder is coupled to the base so that the major diameter of the oblong circular cross section bore of the cylinder tube is in parallel with the base.

20. A linear actuator as set forth in claim 16, wherein the rodless cylinder comprises a cylinder tube having an oblong circular cross section bore, and wherein the rodless cylinder is coupled to the base so that the major diameter of the oblong circular cross section bore of the cylinder tube is in parallel with the base.

* * * * *